US007932798B2

(12) United States Patent
Tolle et al.

(10) Patent No.: US 7,932,798 B2
(45) Date of Patent: Apr. 26, 2011

(54) SYSTEM, AN INDUCTIVE POWER DEVICE, AN ENERGIZABLE LOAD AND A METHOD FOR ENABLING A WIRELESS POWER TRANSFER

(75) Inventors: Tobias Georg Tolle, Beerse (BE); Eberhard Waffenschmidt, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 327 days.

(21) Appl. No.: 11/908,409

(22) PCT Filed: Mar. 9, 2006

(86) PCT No.: PCT/IB2006/050740

§ 371 (c)(1), (2), (4) Date: Sep. 12, 2007

(87) PCT Pub. No.: WO2006/097870

PCT Pub. Date: Sep. 21, 2006

(65) Prior Publication Data

US 2008/0204181 A1 Aug. 28, 2008

(30) Foreign Application Priority Data

Mar. 14, 2005 (EP) ..... 05101962

(51) Int. Cl.
*H01F 21/04* (2006.01)

(52) U.S. Cl. ..... 336/115; 336/118; 336/119

(58) Field of Classification Search ..... 336/115, 336/118, 119

See application file for complete search history.

(56) References Cited

U.S. PATENT DOCUMENTS

| | | | | |
|---|---|---|---|---|
| 4,352,960 | A | 10/1982 | Dormer et al. | |
| 4,538,214 | A | 8/1985 | Fisher et al. | |
| 4,736,747 | A | 4/1988 | Drake | |
| 4,920,318 | A * | 4/1990 | Misic et al. | 324/318 |
| 6,473,652 | B1 * | 10/2002 | Sarwal et al. | 607/62 |
| 6,676,592 | B2 * | 1/2004 | Ball et al. | 600/25 |
| 6,850,803 | B1 * | 2/2005 | Jimenez et al. | 607/61 |

(Continued)

FOREIGN PATENT DOCUMENTS

| | | | |
|---|---|---|---|
| DE | 4433701 | A1 | 3/1996 |

(Continued)

*Primary Examiner* — Anh T Mai
*Assistant Examiner* — Joselito Baisa

(57) ABSTRACT

The system 1 according to the invention comprises an energizable load 2 and an inductive powering device 9 and a permanent magnet 8 arranged on the conductor 4 for interacting with the further conductor 9*a* for aligning the inductor winding 6 with respect to the further inductor winding 9*b*. The energizable load 2 for enabling the inductive power receipt comprises a wiring 6 which cooperates with the conductor 4 for forming a secondary wiring of the transformer. In order to form the system for inductive energy transfer, the energizable load 2 is to be placed on the inductive powering device 9, whereby the surface 2*a* will contact the surface 7. The inductive powering device 9 comprises a further magnetizable conductor 9*a* provided with a further winding 9*b* thus forming a primary wiring of the split-core electric transformer. When the winding 6 is brought in the vicinity of the further winding 9*b*, the magnetic force acting on the further magnetizable conductor 9*a* serves for an instant proper mutual alignment of the winding 6 and further winding 9*b*. The invention further relates to a inductive powering device, an inductive load and a method for enabling an inductive energy transfer to en energizable load.

10 Claims, 3 Drawing Sheets

U.S. PATENT DOCUMENTS

Figure 1:
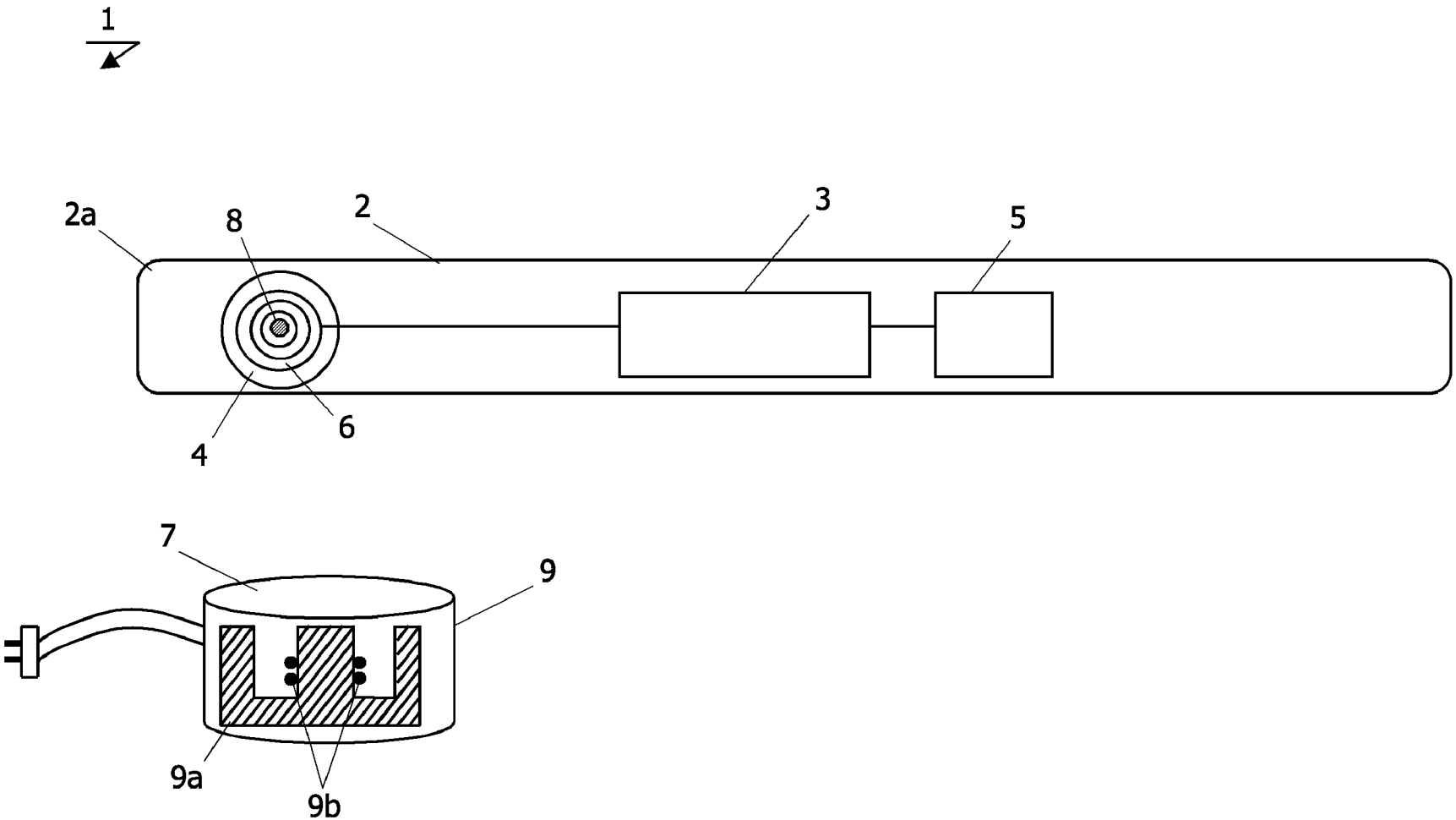

| | | | | |
|---|---|---|---|---|
| 6,926,794 | B2 * | 8/2005 | Kohama et al. | 156/308.2 |
| 7,349,741 | B2 * | 3/2008 | Maltan et al. | 607/57 |
| 7,583,500 | B2 * | 9/2009 | Ligtenberg et al. | 361/147 |
| 2008/0204021 | A1 * | 8/2008 | Leussler et al. | 324/318 |

FOREIGN PATENT DOCUMENTS

| | | | |
|---|---|---|---|
| EP | 0180380 | B1 | 5/1991 |
| EP | 0823717 | A2 | 2/1998 |
| EP | 1253695 | A2 | 10/2002 |

* cited by examiner

SYSTEM, AN INDUCTIVE POWER DEVICE, AN ENERGIZABLE LOAD AND A METHOD FOR ENABLING A WIRELESS POWER TRANSFER

The invention relates to a system for enabling an inductive power transfer from an inductive powering device to an energizable load, wherein the energizable load comprises an inductor winding cooperating with a magnetizable conductor and wherein the inductive powering device comprises a further inductive winding cooperating with a further magnetizable conductor, said further inductive winding being conceived to interact with the inductor winding for the purpose of forming a split-core electric transformer.

The invention further relates to an inductive powering device for a wireless power transfer to an energizable load comprising an inductor winding cooperating with a magnetizable conductor, said powering device comprising:

a further magnetizable conductor;

a further inductive winding cooperating with the further magnetizable conductor and being conceived to interact with the inductor winding for the purpose of forming an electric transformer.

The invention still further relates to an energizable load comprising an inductor winding cooperating with a magnetizable material, said energizable load being conceived to form a part of the system described in the foregoing.

The invention still further relates to a method of enabling an inductive power transfer from an inductive powering device to an energizable load, wherein the energizable load comprises an inductor winding cooperating with a magnetizable conductor and wherein the inductive powering device comprises a further inductive winding cooperating with a further magnetizable conductor, said further inductive winding being conceived to interact with the inductor winding for the purpose of forming a split-core electric transformer.

An embodiment of the system as set forth in the opening paragraph is known from EP 0 823 717 A2. The known system is arranged for enabling charging of a chargeable battery, notably that of an electric car, by means of an external power supply. The external power supply and the chargeable battery are arranged to form a split-core electric transformer. In order to align respective portions of the thus formed split-core transformer, both the known inductive powering device and the known energizable load comprise a plurality of permanent magnets, with a set of permanent magnets being arranged on the side of the inductive powering device and the further set of permanent magnets being arranged on the side of the energizable load. The known arrangement of the permanent magnets is provided to enable cooperation between respective units of permanent magnets, which have to be compatibly oriented in space with respect to their poles. Also, the first set of permanent magnets and the further set of permanent magnets are positioned at the periphery of the magnetizable conductor and the further magnetizable conductor, exerting substantially no magnetic force thereon.

It is a disadvantage of the known system for inductive power transfer that it requires a compatible spatial arrangement of the respective sets of permanent magnets, as a result of which the known system is not versatile with respect to a possible variety of potentially energizable loads.

It is an object of the invention to provide a system for enabling an inductive energy transfer to the energizable load, said system being compatible with respect to external energizable loads.

To this end, in the system according to the invention, the thus formed split-core electric transformer is arranged with a permanent magnet conceived for exerting a magnetic force on the magnetizable conductor or on the further magnetizable conductor for aligning the inductor winding with respect to the further inductor winding.

The technical measure of the invention is based on the insight that for enabling versatile compatibility of the components forming the system, it is sufficient to provide a permanent magnet only on the side of one component, either the inductive powering device, or the energizable load. Preferably, the permanent magnet is integrated in the further magnetizable conductor at the side of the inductive powering device, which most often will be a stationary unit. In this case, the permanent magnet will exert a magnetic force on the magnetizable conductor of the energizable load, notably a displaceable energizable load. Thus, any energizable load comprising a magnetizable conductor will readily form a split-core electric transformer with the inductive powering device, the mutual alignment between the inductive winding and the further inductive winding being achieved due to a magnetic force of the permanent magnet. Preferably, the energizable load is implemented as a sensor or other device, for example a watch, or a device to measure the blood pressure or the heart rate. Still preferably, the energizable load is integrated in a wearable article, for example a belt or a t-shirt. In this case, the energizable load does not have excessive weight due to accessory magnets and thus is comfortable in use. Alternatively, it may be energizable electronic equipment which is not conceived to be worn by a person but to be positioned near him, for example on a table or beside a patient's bed. Further advantageous details of the system according to the invention are described with reference to FIG. 1.

An inductive powering device according to the invention, wherein the further magnetizable conductor comprises a permanent magnet for cooperating with the magnetizable conductor, thereby aligning the inductor winding with respect to the further inductor winding.

The technical measure is based on the insight that by integrating a permanent magnet into the magnetic circuit that provides inductive charging, an advantageous synergistic effect is achieved. The permanent magnet increases the magnetic force to the extent that the two components forming the split-core electric transformer are self-aligning or even clutch together. Preferably, the permanent magnet is arranged substantially in a central portion of the further magnetizable conductor. Further advantageous details of the inductive powering device according to the invention are described with reference to FIG. 2.

An energizable load according to the invention comprises an inductor winding cooperating with a magnetizable material, said energizable load being conceived to form a part of the system, as is described with reference to the foregoing. Preferably, the energizable load is implemented as a sensor or other device, for example a watch, or a device to measure the blood pressure or the heart rate. Still preferably, the energizable load is integrated in a wearable article, for example a belt or a t-shirt. Alternatively, the energizable load may be implemented as energizable electronic equipment which is not conceived to be worn by a person, but to be positioned near him, for example on a table or beside a patient's bed. Preferably, in case the energizable load is implemented in a substantially planar structure, the energizable load comprises the inductive winding provided with a ferrite plate and is conceived to cooperate with the inductive powering device comprising the permanent magnet, as is described with reference to the foregoing. Still preferably, the energizable load comprises a system for measuring data, notably for monitoring a vital sign.

Alternatively, the energizable load may comprise the permanent magnet and may be conceived to cooperate with an inductive powering device which does not comprise any alignment means in the form of permanent magnets. Such an energizable load may still be implemented as a substantially planar structure, may be embedded in a wearable article and comprise a system for measuring data, notably for monitoring a vital sign. Further advantageous details of the energizable load will be described with reference to FIGS. 3 and 4.

In the method according to the invention, wherein the thus formed split-core electric transformer is arranged with a permanent magnet conceived for exerting a magnetic force on the magnetizable conductor or on the further magnetizable conductor for mutually aligning the inductor winding and the further inductor winding, said method comprising the steps of:

bringing the inductor winding in the vicinity of the further inductor winding for forming the split-core electric transformer, thus allowing said mutual alignment;

allowing a power transfer from the inductive powering device to the energizable load.

A further advantageous embodiment of the method according to the invention is described with reference to Claim 10. The method according to the invention may be practiced in hospitals, in sports centers or any other industrial entity which practices patient monitoring.

FIG. 1 presents a schematic view of an embodiment of the system for inductive power transfer according to the invention.

Figure 2:
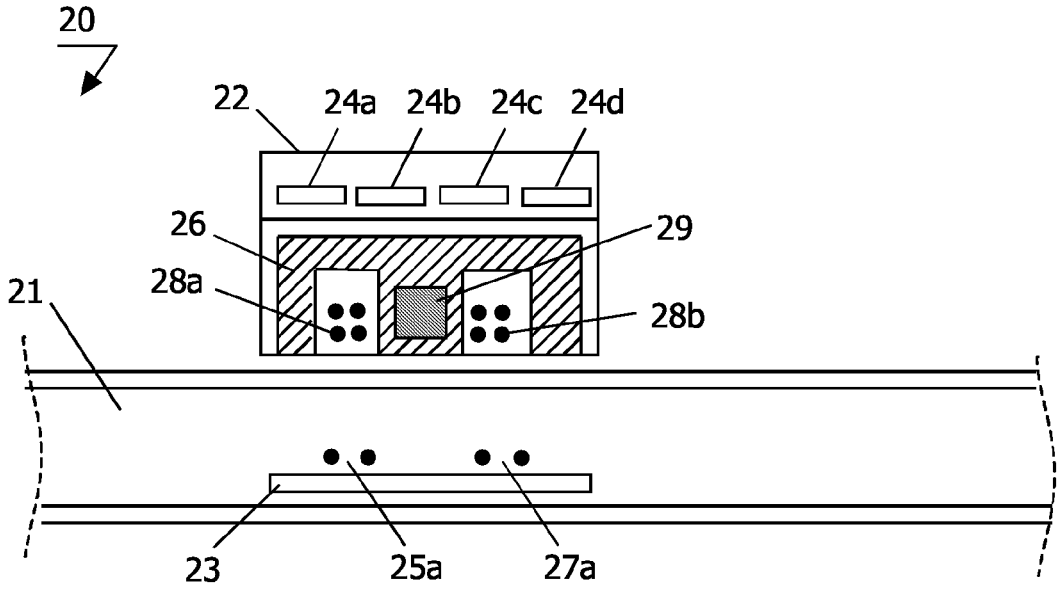

FIG. 2 presents a schematic view of an embodiment of the inductive powering device according to the invention.

Figure 3:
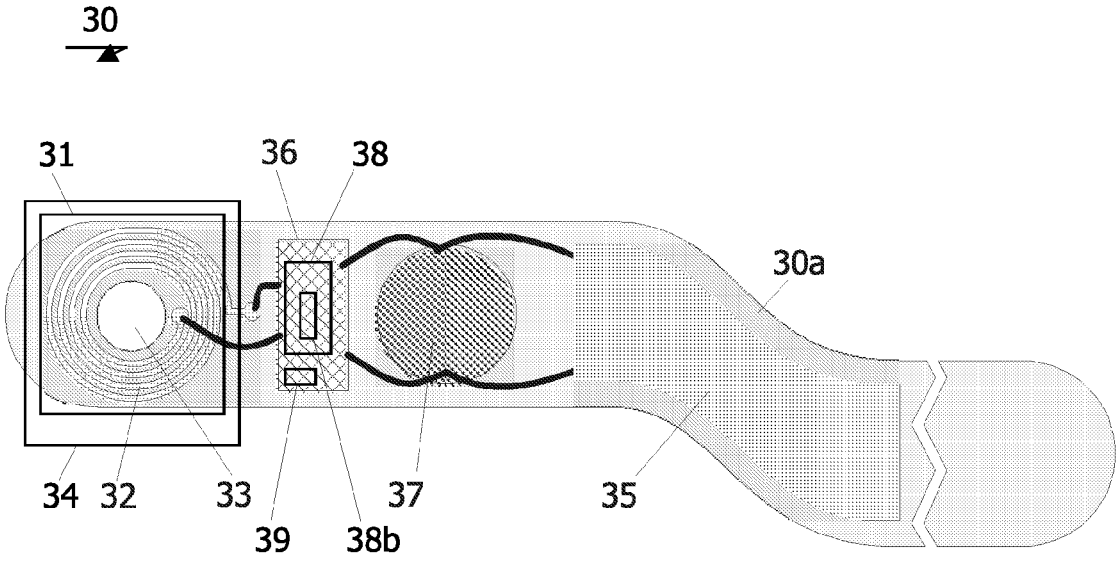

FIG. 3 presents a schematic view of an embodiment of the energizable load according to the invention.

Figure 4:
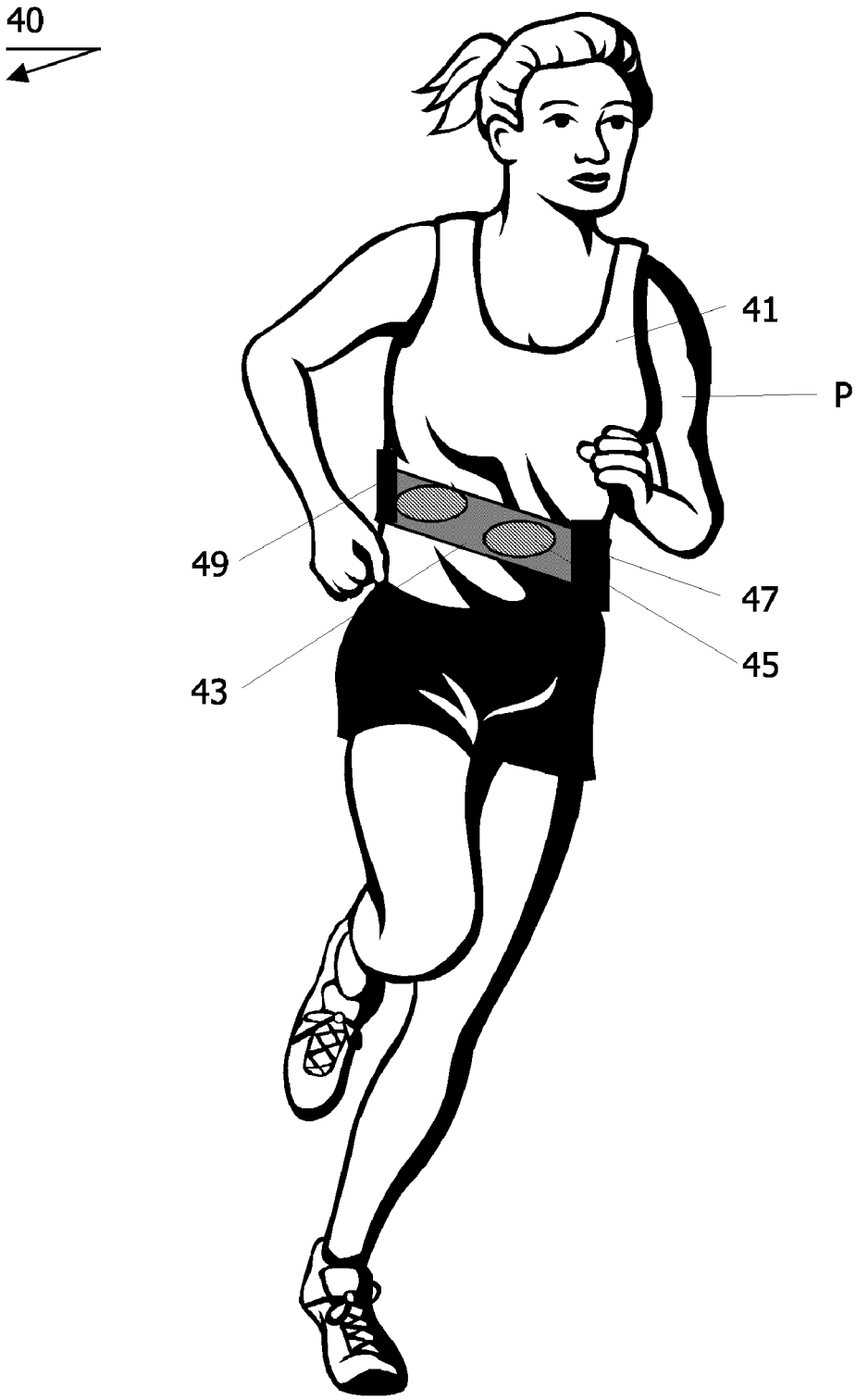

FIG. 4 presents a schematic view of a further embodiment of the energizable load according to the invention.

FIG. 1 presents a schematic view of an embodiment of the system for inductive power transfer according to the invention. The system 1 comprises an energizable load 2 and an inductive powering device 9. In this particular embodiment, the permanent magnet 8 is arranged on the conductor 4, substantially in the center thereof. The energizable load 2 for enabling the inductive power receipt comprises a wiring 6, which cooperates with the conductor 4 for forming a secondary wiring of the transformer. A plurality of possible embodiments of the energizable load are envisaged, including chargeable mobile electronic devices. Preferably, the energizable load 2 is arranged to form a wearable unit for measuring and/or monitoring a suitable vital sign. In this case the energizable load may be implemented as a belt, a band, a piece of wearable clothing, etc. For the purpose of data measurement and/or monitoring, the energizable load 2 may further comprise a data measuring unit 5 arranged in electrical connection with a rechargeable battery 3. Details of implementation of a data measuring and/or monitoring system are known per se to a person skilled in the art and will not be explained in detail here.

In order to form the system for inductive energy transfer, the energizable load 2 is to be placed on the inductive powering device 9, thus causing the surface 2*a* to contact the surface 7. The inductive powering device 9 comprises a further magnetizable conductor 9*a* provided with a further winding 9*b*, thus forming a primary wiring of the split-core electric transformer. When the winding 6 is brought in the vicinity of the further winding 9*b*, the magnetic force acting on the further magnetizable conductor 9*a* provides for instant proper mutual alignment of the winding 6 and further winding 9*b*.

FIG. 2 presents a schematic view of an embodiment of the inductive powering device according to the invention. This embodiment shows a cross-section of the system 20 according to the invention when the energizable load 21 is aligned with the inductive powering device 22. In this embodiment a solution is shown when the permanent magnet 29 is arranged substantially in a central portion of an E-shaped further magnetizable conductor 26 provided with the further winding 28*a*, 28*b*. This solution is particularly advantageous when the energizable load 21 should not have excessive weight, for instance, in the case when the energizable load 21 forms a part of a suitable monitoring system and is designed to be worn constantly. In this case the energizable load may be integrated in a suitable wearable article, like a t-shirt, (sports)-bra, belt, armband, etc. In this case it is preferable that the magnetizable conductor comprises a flexible plate of a ferrite material to enable good conformance of the load 21 to a body of the individual wearing it. It is noted that relative dimensions of the energizable load 21 are exaggerated for clarity reasons. The inductive powering device 22 may further comprise suitable electronics 24*a*, 24*b*, 24*c*, 24*d* for enabling controlled powering of the energizable load. It may further be arranged to distinguish between different loads which may be powered by it.

FIG. 3 presents a schematic view of an embodiment of the energizable load according to the invention. As is indicated earlier, a plurality of suitable energizable loads is possible. This particular embodiment shows a monitoring system 30, integrated on a piece of a wearable article 30*a*, for example an elastic belt. The monitoring system 30 comprises the inductor winding 32, which is preferably manufactured on a flexible printed circuit board 31. It must be noted that the inductor winding 32 may stretch further than is strictly required to surround the leg of the transformer. This feature has the advantage that the inductor winding gains a higher tolerance to placing errors, thus further improving the reliability of the wireless power transfer. Still preferably, the board 31 is sealed in a water-impermeable unit 34 so that the whole monitoring system can be washable. This feature is particularly advantageous for monitoring systems arranged for continuous monitoring, for example of a health-related parameter. In case the monitoring system 30 is arranged with magnetic means for alignment of a core of a suitable wireless powering device, a permanent magnet 33 is positioned, preferably in a central portion of a thus formed primary wiring of the split-core electric transformer. When in the inductor winding 32 a current is induced, it can be, for example, used to charge a rechargeable battery 37 in the receiver circuit. To adapt the induced current to the battery 37, an electronic circuit 36 is used. This electronic circuit comprises, in the simplest case, a rectifier 38*b* to convert the induced ac current to a dc charging current. In a more sophisticated solution, this circuit comprises a charge control circuit 38, which controls the charging current and the charging time and which is able to manage load schemes dedicated to the battery type. It may also have indicators 39 for the status of the charging process. The system 30 further comprises a system 35 arranged for measuring data. Preferably, data related to a vital sign are measured, like blood pressure, heart rate, respiration rate, etc. The monitoring system 30 induces only a small amount of external radiation of magnetic fields, because the magnetic circuit is closed. The radiation is comparable to that of a standard wired charger, which also contains a transformer.

FIG. 4 presents a schematic view of a further embodiment of the energizable load according to the invention. The wearable monitoring system 40 according to the invention is arranged as a body-wear 41 for an individual P. The monitoring system 40 comprises a flexible carrier 43 arranged for supporting suitable sensing means 45. Preferably, for improving wearing comfort, the carrier 43 is implemented as an elastic belt, whereto; for example, a number of electrodes (not shown) are attached. It must be noted that although in the current embodiment a T-shirt is depicted, any other suitable wearables are possible, including, but not limited to, underwear, a brassier, a sock, a glove, a hat. The sensing means 45 is arranged to measure a signal representative of a physiological condition of the individual P. Preferably, the inductor winding is woven or stitched into the fabric of a suitable wearable in the form of a spiral. This solution is most comfortable and flexible. The purpose of such monitoring may be a medical one, for example, monitoring of a temperature, a heart condition, a respiration rate, or any other suitable parameter. Alternatively, the purpose of monitoring may be fitness-or sport-related, which means that an activity of the individual P is being monitored. For this purpose, the sensing means 45 is brought into contact with the individual's skin. Due to the elasticity of the carrier 43, the sensing means experiences a contact pressure, which keeps it substantially in place during a movement of the individual P. The measured signal is forwarded from the sensing means 45 to the control unit 47 for purposes of signal analysis or other data processing. The control unit 47 may be coupled to a suitable alarming means (not shown). The monitoring system 45 according to the invention further comprises a conductor loop 49, which is arranged to be energizable using wireless energy transfer. This energy may be received from the wireless inductive powering device, as is shown with reference to FIG. 1, thus forming the wireless inductive powering system, whereby means are provided for instant mutual alignment of the transformer wirings, as is described with reference to the foregoing.

The invention claimed is:

1. A system for enabling an inductive power transfer from an inductive powering device to an energizable load, wherein the energizable load comprises an inductor winding cooperating with a magnetizable conductor and connected to a rechargeable battery, and wherein the inductive powering device comprises a further inductive winding cooperating with a further magnetizable conductor, said further inductive winding interacting with the inductor winding for forming a split-core electric transformer, wherein the split-core electric transformer is arranged with a permanent magnet such that it exerts a magnetic force on the magnetizable conductor or on the further magnetizable conductor for aligning the inductor winding with respect to the further inductive winding, wherein when the inductor winding is aligned with the further inductive winding, electrical power charges the rechargeable battery, wherein the energizable load is integrated in a wearable article, and wherein the inductor winding is woven or stitched into fabric of the wearable article.

2. The system according to claim 1, wherein the permanent magnet is arranged in a further magnetizable materials.

3. An energizable load comprising an inductor winding cooperating with a magnetizable material, said energizable load being conceived to form a part of the system as claimed in claim 1.

4. An energizable load according to claim 3, wherein said load further comprises a system for measuring data.

5. An energizable load according to claim 4, wherein said system is arranged for monitoring a vital sign.

6. The system of claim 1 further comprising a system for monitoring a health parameter.

7. An inductive powering device for a wireless power transfer to an energizable load comprising an inductor winding cooperating with a magnetizable conductor, said powering device comprising:

a further magnetizable conductor;

a further inductive winding cooperating with the further magnetizable conductor and interacting with the inductor winding for forming an electric transformer; and a rechargeable battery, wherein the further magnetizable conductor comprises a permanent magnet for cooperating with the magnetizable conductor, thereby aligning the inductor winding with respect to the further inductive winding, wherein when the inductor winding is aligned with the further inductive winding, electrical power charges the rechargeable battery, wherein the energizable load is integrated in a wearable article, and wherein the inductor winding is woven or stitched into fabric of the wearable article.

8. The inductive powering device according to claim 7, wherein the permanent magnet is arranged substantially in a central portion of the further magnetizable conductor.

9. A method of enabling an inductive power transfer from an inductive powering device to an energizable load, wherein the energizable load comprises an inductor winding cooperating with a magnetizable conductor and connected to a rechargeable battery, and wherein the inductive powering device comprises a further inductive winding cooperating with a further magnetizable conductor, said further inductive winding interacting with the inductor winding for forming a split-core electric transformer, wherein the split-core electric transformer is arranged with a permanent magnet such as to exert a magnetic force on the magnetizable conductor or on the further magnetizable conductor for mutually aligning the inductive winding and the further inductive winding, wherein the energizable load is integrated in a wearable article, and wherein the inductor winding is woven or stitched into fabric of the wearable article, said method comprising the steps of:

bringing the inductor winding in the vicinity of the further inductive winding for forming the split-core electric transformer, thus allowing said mutual alignment;

allowing a power transfer from the inductive powering device to the energizable load when the inductor winding is aligned with the further inductive winding to charge the rechargeable battery.

10. A method according to claim 9, wherein for the energizable load a system for measuring data is selected, said method further comprising the steps of:

detaching the energizable load from the inductive powering device;

carrying out data measurement with the energizable load.

* * * * *